United States Patent [19]

Matsui et al.

[11] Patent Number: 4,511,414

[45] Date of Patent: Apr. 16, 1985

[54] METHOD OF PRODUCING A WATER-IN-OIL EMULSION EXPLOSIVE

[75] Inventors: Fumio Matsui, Handa; Shin Aono, Chita; Hiroshi Sakai, Chita; Katsuhide Hattori, Chita; Shigeru Kakino, Chita, all of Japan

[73] Assignee: Nippon Oil and Fats Co. Ltd., Japan

[21] Appl. No.: 632,870

[22] Filed: Jul. 20, 1984

[30] Foreign Application Priority Data

Aug. 1, 1983 [JP] Japan ..... 58-140924

[51] Int. Cl.[3] ..... D03D 23/00

[52] U.S. Cl. ..... 149/109.6; 149/2; 149/21; 149/46; 264/3 C

[58] Field of Search ..... 149/2, 21, 46, 109.6; 264/3 C

[56] References Cited

U.S. PATENT DOCUMENTS

| | | | |
|---|---|---|---|
| 4,216,040 | 8/1980 | Sudweeks et al. | 149/2 |
| 4,315,784 | 2/1982 | Hattori et al. | 149/2 |
| 4,315,787 | 2/1982 | Hattori et al. | 149/2 |
| 4,394,198 | 7/1983 | Takeuchi et al. | 149/2 |
| 4,398,976 | 8/1983 | Hattori et al. | 149/2 |
| 4,410,378 | 10/1983 | Hattori et al. | 149/2 |
| 4,414,044 | 11/1983 | Takeuchi et al. | 149/2 |

*Primary Examiner*—Stephen J. Lechert, Jr.
*Attorney, Agent, or Firm*—Parkhurst and Oliff

[57] ABSTRACT

A water-in-oil emulsion explosive comprising an aqueous solution of inorganic oxidizer, an oil, an emulsifier and hollow microspheres, and having high low-temperature detonability and storage stability can be produced without causing breakage of the hollow microspheres through particular emulsifying and kneading steps, in which emulsifying step the aqueous solution of inorganic oxider, the oil and the emulsifier are fully emulsified into a water-in-oil emulsion in an emulsifying machine having a novel structure, and in which kneading step the resulting water-in-oil emulsion is kneaded together with the hollow microspheres by means of agitating blades, said agitating blades being arranged in the kneader and carrying out concurrent by rotary motion and up and down movements.

1 Claim, 4 Drawing Figures

METHOD OF PRODUCING A WATER-IN-OIL EMULSION EXPLOSIVE

BACKGROUND OF THE INVENTION (1) Field of the Invention

The present invention relates to a method of producing a water-in-oil emulsion explosive (hereinafter, referred to as W/O emulsion explosive), and more particularly relates to a method of producing a W/O emulsion explosive, wherein a stable water-in-oil emulsion (hereinafter, referred to as W/O emulsion) is produced in a short time through a specifically limited emulsifying step, and the resulting W/O emulsion is kneaded together with hollow microspheres through a specifically limited kneading step, whereby the W/O emulsion and the hollow microspheres can be homogeneously kneaded in a short time without substantially causing breakage of the hollow microspheres.

(2) Description of the Prior Art

U.S. Pat. No. 4,138,281 specification discloses a method of producing W/O emulsion explosive comprising aqueous solution of inorganic oxidizer, oil, emulsifier and hollow microspheres. This method comprises five steps as illustrated in FIG. 1, that is, a step for conditioning an aqueous solution of inorganic oxidizer, a step for conditioning a mixture of oil and emulsifier, a step for emulsifying the mixture of oil and emulsifier together with the above described aqueous solution of inorganic oxidizer into a W/O emulsion, a step for kneading the resulting W/O emulsion together with hollow microspheres, and a step for packing the resulting W/O emulsion explosive. Among these steps, the emulsifying and kneading steps are most important. That is, whether a good W/O emulsion is obtained or not has a high influence upon the quality and storage stability of the resulting W/O emulsion explosive. The kneading step is carried out in order to disperse homogeneously hollow microspheres having a very small specific gravity into a W/O emulsion having a relatively large specific gravity, and whether a good dispersion is formed or not has a high influence upon the explosion property and other properties of the resulting W/O emulsion explosive.

However, the above described U.S. patent discloses the use of an ordinary continuous mixer in the emulsifying step, and the use of an ordinary continuous kneader in the kneading step, and does not disclose the use of a particular emulsifying machine and a particular kneader.

Moreover, the method described in the above described U.S. patent comprises a large number of steps, and therefore a long time is required for the production of W/O emulsion explosive, and the method is not desirable as a commercial method. In order to overcome this drawback, the inventors have already proposed in U.S. Pat. No. 4,410,378 a method of producing W/O emulsion explosive, wherein emulsification and kneading are carried out in one step.

That is, U.S. Pat. No. 4,410,378 discloses a method of producing a W/O emulsion explosive, wherein hollow microspheres, and a mixture of aqueous solution of inorganic oxidizer, oil and emulsifier are separately supplied into a common passage; the hollow microspheres and the mixture of the aqueous solution of inorganic oxidizer, the oil and the emulsifier are emulsified and kneaded on the surface of a disc, which is arranged on the downstream side of the passage and has projections, while rotating the disc; the emulsified and kneaded mixture is flowed down from the outer peripheral portion of the disc into a kneading room formed under the disc, while continuing the emulsification and kneading; and emulsified and kneaded mixture is taken out from the kneading room.

Although the method of U.S. Pat. No. 4,410,378 can produce W/O emulsion explosive in a very short time, the method still has problems to be solved that, due to the concurrent emulsification and kneading, a high shear force acts on hollow microspheres, and some kinds of hollow microspheres, for example, shirasu hollow microspheres (shirasu is a kind of volcanic ash) and the like are broken in a large amount during the emulsifying and kneading step, and the resulting W/O emulsion explosive is poor in the quality and in the explosion performance.

The inventors have made various investigations in order to solve this problem, and have found that, when the emulsifying and kneading machine used in the above described emulsifying and kneading step is used as an emulsifying machine in an emulsifying step and is connected to a specifically limited kneading machine used in a kneading step following to the above emulsifying step, the breakage of hollow microspheres can be noticeably decreased and a W/O emulsion explosive can be obtained in a short time. As the result, the present invention has been accomplished.

SUMMARY OF THE INVENTION

The feature of the present invention is the provision of a method of producing water-in-oil emulsion explosive, comprising mixing an aqueous solution of inorganic oxidizer with a premixture of oil and emulsifier, emulsifying the mixture into a water-in-oil emulsion through the following emulsifying step (a), and then kneading the resulting water-in-oil emulsion together with hollow microspheres in the following kneading step (b):

(a) said emulsifying step being an emulsifying step, wherein the above described mixture is fed into an emulsifying machine on a disc arranged in the machine and having projections; the mixture is flowed towards the inner wall of the emulsifying machine, while rotating the disc and imposing a shear force to the mixture by the projections arranged on the disc; the emulsified mixture is flowed down from the outer peripheral portion of the disc into a room formed under the disc; the emulsified mixture is further mixed in the room and is extruded therefrom by means of an extruding blade arranged in the room to produce a water-in-oil emulsion; and (b) said kneading step being a kneading step, wherein the above obtained water-in-oil emulsion is kneaded together with hollow microspheres by means of agitating blades which carry out concurrently rotary motion and up and down movements.

DESCRIPTION OF THE PREFERRED EMBODIMENT

Figure 1:
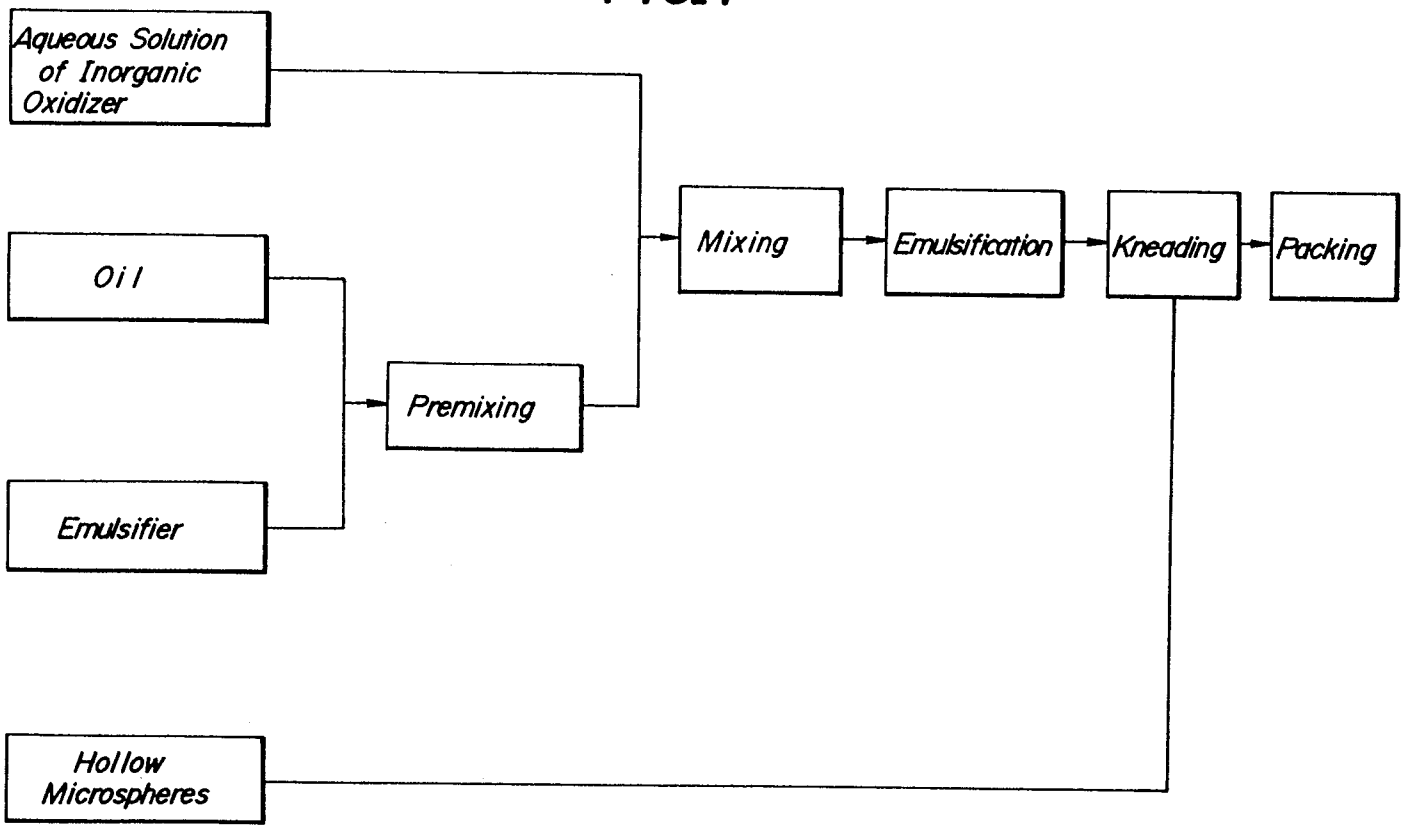
FIG. 1 is a flow sheet illustrating a conventional method of producing W/O emulsion explosive.

The W/O emulsion explosive to be handled in the present invention includes all commonly known W/O emulsion explosives.

As the aqueous solution of inorganic oxidizer to be used in the present invention, there can be used an aqueous solution of ammonium nitrate or an aqueous solution of a mixture of ammonium nitrate with the other inorganic oxidizer salt, such as nitrate, chlorate or the like of alkali metal or alkaline earth metal.

The oils to be used in the present invention include fuel oil and wax. As the fuel oil, mention may be made of, for example, hydrocarbon and its derivatives, and the like. As the wax, mention may be made of, for example, wax derived from petroleum, mineral wax, animal wax, insect wax and the like. The amount of these fuel oils and waxes to be contained in the resulting W/O emulsion explosive can be freely selected depending upon the desired property of the explosive.

The emulsifiers to be used in the present invention include all emulsifiers which form W/O emulsion, for example, sorbitain fatty acid ester, glyceride of fatty acid, oxazoline derivative, imidazoline derivative and the like.

The hollow microspheres to be used in the present invention include inorganic hollow microspheres, such as glass, alumina, shirasu hollow microspheres and the like; carbonaceous hollow microspheres, such as pitch hollow microspheres and the like; and synthetic resin hollow microspheres, such as phenolic resin, Saran hollow microspheres and the like.

In the present invention, 99–90% (in weight basis, hereinafter "%" means % by weight) of a W/O emulsion and 1–10% of hollow microspheres are generally kneaded in the kneading step.

Hereinafter, the present invention will be explained in more detail referring to the drawings.

Figure 2:
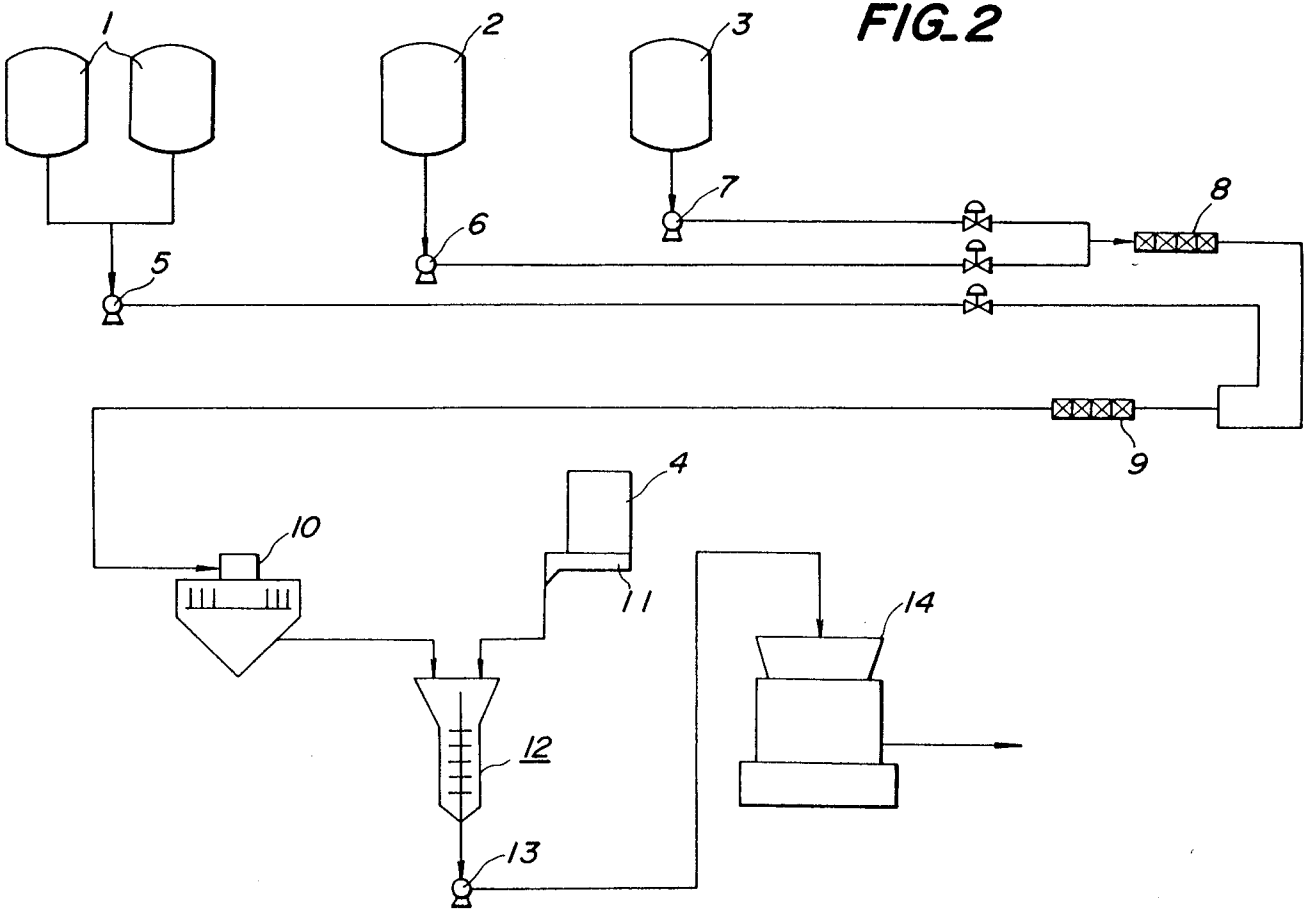
FIG. 2 is a flow sheet illustrating one embodiment of the method of the present invention for producing W/O emulsion explosive.
Figure 3:
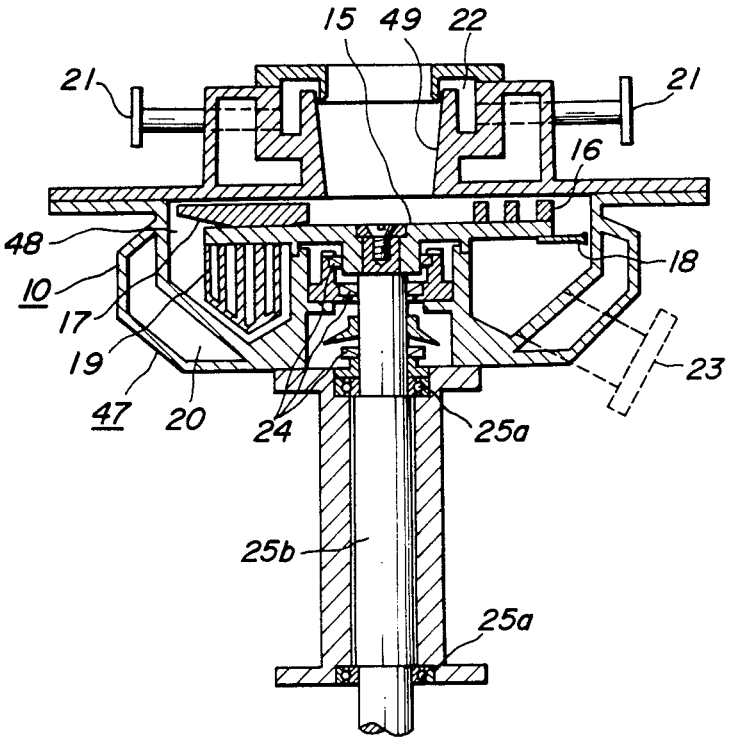
FIG. 3 is a vertical sectional view of one embodiment of an emulsifying machine to be used in the emulsifying step in the present invention.
Figure 4:
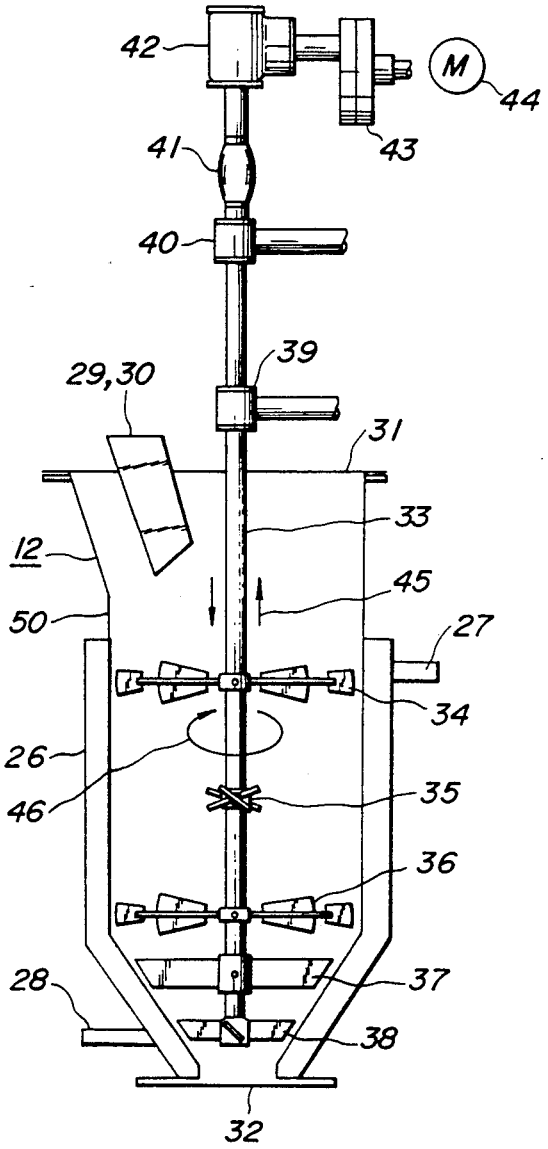
FIG. 4 is a vertical sectional view of one embodiment of a kneader to be used in the kneading step in the present invention.

FIG. 2 is a flow sheet illustrating one embodiment of the method of the present invention for producing W/O emulsion explosive; FIG. 3 is a vertical sectional view of one embodiment of an emulsifying machine to be used in the emulsifying step in the present invention; and FIG. 4 is a vertical sectional view of one embodiment of a kneader to be used in the kneading step in the present invention.

Referring to FIG. 2, an aqueous solution of inorganic oxidizer is kept at a temperature (generally 70°–130° C.) not less than the crystallization temperature of the inorganic oxidizer in a tank 1 for aqueous solution of oxidizer; an oil and an emulsifier are heated and kept at about 70°–100° C. in an oil tank 2 and in a melting tank 3, respectively; and hollow microspheres are kept in a feeder 4 for powdery material.

The oil and emulsifier heated to a given temperature are flowed by means of supply pumps 6 and 7 respectively, and are controlled to given flow rates by means of respective flow rate regulators. The quantitatively supplied two liquids are premixed in a static mixer 8, and the premixture of oil and emulsifier is fed into another static mixer 9. The aqueous solution of inorganic oxidizer heated up to a given temperature is flowed by means of a supply pump 5, is controlled to a given flow rate by means of a flow rate regulator at the same time with the flow rate control of the oil and emulsifier, and then fed into the static mixer 9 at the above controlled flow rate. The aqueous solution of inorganic oxidizer fed into the static mixer 9 is mixed therein with the above described premixture of oil and emulsifier, and the resulting mixture is fed into an emulsifying machine 10 and emulsified therein in a short time to form a W/O emulsion. The resulting W/O emulsion is exhausted from the emulsifying machine 10, and then fed into a kneader 12. The hollow microspheres to be kneaded with the W/O emulsion are concurrently fed into the kneader 12 from the feeder 4 for powdery material through a metering feeder 11 for powdery material.

In the kneader 12, the above described W/O emulsion and hollow microspheres are homogeneously kneaded in a high efficiency to form a W/O emulsion explosive composition, and the resulting explosive composition is fed into a packing machine 14 by means of a pump 13, and a W/O emulsion explosive is produced therein.

An explanation will be made with respect to the characteristic emulsifying step of the present invention.

In the emulsifying step of the present invention, an emulsifying machine illustrated, for example, in FIG. 3 is used.

Referring to FIG. 3, an emulsifying machine 10 comprises a vessel body 47 provided with a supply hole 21 for liquid, an exhaust hole 23 and a jacket 20; and a disc (homogenizing disc) 15 having a large number of projections 16 and a scraping blade 17 arranged on its upper surface at its peripheral portion, another scraping blade 18 arranged on its lower surface at its peripheral portion and extending laterally from its edge, and further an extruding blade 19 at its lower surface, which disc 15 is fixed to a rotating shaft **25*b*. The rotating shift 25*b* is sealed from the liquid by a sealing member 24, and is so designed that liquid and emulsion do not at all flow into a bearing portion 25*a***.

A mixture obtained by mixing in a static mixer 9 a premixture of oil and emulsifier with an aqueous solution of inorganic oxidizer is fed into an emulsifying machine 10 through its supply hole 21 for liquid, flowed down along the inner wall surface 49 of a cylindrical portion in the from of a thin film through its overflow hole 22, and then supplied on the upper portion of the disc 15, which has previously been rotated at a given revolution number of 100–5,000 rpm. The mixture supplied on the disc 15 is instantaneously splashed on the disc to the inner wall 48 of the emulsifying machine by the action of centrifugal force, while being subjected to a shear force by a large number of the projections 16 and the scraping blades 17 and 18 fixed to the disc 15, flowed down along the inner wall 48 of the emulsifying machine, fed into a room formed under the disc, and subjected to a sufficiently large shear force by an extruding blade 19 fixed to the lower surface of the disc 15, and then the resulting W/O emulsion is exhausted from the emulsifying machine through its exhaust hole 23. The residence time of the mixture in the emulsifying machine can be freely changed by changing the diameter of the exhaust hole 23.

Accordingly, in the above described emulsifying step, hollow microspheres have not yet been mixed with a mixture of aqueous solution of inorganic oxidizer, oil and emulsifier, and therefore breakage of hollow microspheres does not occur at all (In U.S. Pat. No. 4,410,378, a mixture containing hollow microspheres is emulsified in this emulsifying step.).

Hereinafter, an explanation will be made with respect to the characteristic kneading step of the present invention.

In the kneading step of the present invention, a kneader illustrated, for example, in FIG. 4 is used.

Referring to FIG. 4, a kneader 12 consists of an agitating shaft 33 which has agitating blades 34, 35 and 36, each being arranged in a direction perpendicular to the direction of the shaft and being shifted by 90° from each other, and extruding blades 37 and 38; an upper cover 31 having a feed inlet 29 for emulsion and a feed inlet 30 for hollow microspheres; and a kneader body 50 having a bottom exhaust hole 32 and a jacket 26.

The agitating shaft 33 is held by two upper and lower bearings 40 and 39, and is connected to a motor 44 through universal joints 41 and 42 and an eccentric coupling 43. The universal joints and eccentric coupling serve to move the shaft in up and down directions. The motor is provided with a reduction gear which can freely change the number of rotations of the agitating shaft generally within the range of 30–200 rpm. The stroke in the up and down movements and the number of strokes of the agitating shaft can be controlled within the ranges of 30–100 mm and 28–190 spm respectively by changing the gears of the eccentric coupling 43 and the universal joint 42, and the like. In this case, the agitating blade is not moved on the same locus in the kneader by changing a little the number of rotations of the shaft from the number of strokes thereof. That is, due to the agitation by the concurrent rotary motion and up and down movements of the agitating blade, a W/O emulsion having a high viscosity and hollow microspheres having a very small specific gravity can be kneaded in a short time without causing breakages of the W/O emulsion and hollow microspheres. The up and down movements of the shaft further serve to extrude the W/O emulsion explosive composition formed in the kneader. The extruding blades 37 and 38 serve to extrude the explosive composition. When the exhaust hole 32 arranged at the bottom of the kneader is made into such a structure that its cross-sectional area can be changed by means of a slide type damper or the like, the residence time of the kneaded mixture in the kneader can be varied, and the kneaded state thereof can be varied.

As described above, in the method of producing W/O emulsion explosive according to the present invention, emulsification and kneading are carried out in separate steps, but the W/O emulsion forced in the emulsifying machine is directly charged into the kneader without arranging a pump and other members. Therefore, both the steps can be carried out in a simple manner, and moreover a homogeneous W/O emulsion explosive can be produced in a short time without substantially causing breakage of hollow microspheres. Therefore, the method of the present invention is commercially advantageous.

The method of the present invention for producing W/O emulsion explosive will be explained referring to an example and comparative examples.

Comparative Example 1

A W/O emulsion explosive was produced through the steps illustrated in FIG. 1 according to the following method.

Into a tank of 2,000 l capacity were charged 900 kg of ammonium nitrate, 50 kg of sodium chlorate and 100 kg of water, and the resulting mixture was heated to prepare an aqueous solution of inorganic oxidizer kept at 90° C. Into another tank of 200 l capacity were charged 20.1 kg of an emulsifier and 40.2 kg of paraffin, and the resulting mixture was heated, melted and premixed to prepare a liquid mixture kept at 90° C.

The above obtained aqueous solution of inorganic oxidizer was fed into a static mixer at a flow rate of 18.0 kg/min by means of a plunger pump. At the same time, the above obtained liquid mixture was fed into the static mixer at a flow rate of 1.03 kg/min by means of a plunger pump to form a mixture of the aqueous solution of inorganic oxidizer and the liquid mixture therein. The mixture flowed out from the static mixer was fed into an emulsifying machine provided in its interior with a disc, and emulsified therein at a rotation number of 700 rpm (peripheral speed: 10 m/sec) to obtain a W/O emulsion.

The resulting W/O emulsion was fed into a kneader, and at the same time glass hollow microspheres were fed into the kneader at a flow rate of 571 g/min, and the resulting mixture was continuously kneaded at a rotation number of 180 rpm. The residence time of the mass in the kneader was 30 seconds. After the kneading, the resulting W/O emulsion explosive composition was fed into a tube packing machine by means of a pump, and packed into two kinds of W/O emulsion explosive cartridges, one of which had a diameter of 25 mm (100 g) and the other of which had a diameter of 50 mm (1 kg).

The resulting W/O emulsion explosive cartridges were measured just after the production and one year after the production with respect to the density, the detonation velocity at 20° C. by means of a No. 6 electric blasting cap under an unconfined state, and the lowest detonation temperature (low temperature detonability). Further, the breakage of the hollow microspheres during the kneading was measured. The obtained results are shown in the following Table 1.

Comparative Example 2

A W/O emulsion explosive was produced through the steps described in U.S. Pat. No. 4,410,378 according to the following method. The kinds and amount of the starting materials in this Comparative example 2 are the same as those used in the above described Comparative example 1. A premixture of paraffin and emulsifier, and an aqueous solution of inorganic oxidizer were fed into a static mixer at flow rates of the premixture of paraffin and emulsifier of 1.03 kg/min and the aqueous solution of inorganic oxidizer of 18.0 kg/min, and mixed therein, and the resulting mixture was supplied into an emulsifying machine. At the same time, shirasu hollow microspheres were charged on the cylindrical wall surface of the overflow hole or the disc of the emulsifying machine at a constant flow rate of 571 g/min from a feeder for powdery material by means of a metering feeder for powdery material. The disc of the emulsifying machine was rotated at a rate of 700 rpm (peripheral speed: 10 m/sec). After the emulsification and kneading, the resulting W/O emulsion explosive composition was fed into a packing machine (tube packing machine) by means of a pump, and packed into two kinds of W/O emulsion explosive cartridges which had the same diameters as those in Comparative example 1.

The resulting two kinds of W/O emulsion explosive cartridges were subjected to the same tests as described in Comparative example 1. The obtained results are shown in Table 1.

EXAMPLE 1

A W/O emulsion explosive was produced through the steps illustrated in FIG. 2 according to the following method. The kind and amount of the starting materials used in this Example 1 are the same as those used in Comparative example 1.

An aqueous solution of inorganic oxidizer was prepared in a tank 1 and kept at 90° C. Paraffin and an emulsifier were melted in an oil tank 2 and a melting tank 3 respectively, and kept at 90° C. The aqeuous solution of inorganic oxidizer, the paraffin and the emulsifier were quantitatively flowed by means of feed pumps 5, 6 and 7, respectively. The paraffin and emulsifier were premixed in a static mixer 8, and the resulting mixture was fed into another static mixer 9 at a flow rate of 1.03 kg/min. At the same time, the aqueous solution of inorganic oxidizer was fed into the static mixer 9 at a flow rate of 18.0 kg/min, and mixed therein with the mixture of paraffin and emulsifier. In this experiment, the quantitativeness of the feed stocks was not secured by the control of flow rate ratio, but was secured by using metering pumps. The mixture formed in the static mixer 9 was fed into an emulsifying machine 10 of 3 l capacity and emulsified therein. After 10 second residence in the emulsifying machine 10, the resulting W/O emulsion was flowed out from the emulsifying machine and then fed into a kneader 12 and kneaded therein together with shirasu hollow microspheres, which were concurrently fed into the kneader 12 from a feeder 4 for powdery material by means of a metering feeder 11 at a flow rate of 571 g/min. The agitating blade of the kneader was rotated at a rate of 90 rpm (peripheral speed: 1 m/sec). By a residence time of 30 seconds in the kneader, a homogeneously kneaded mixture was obtained.

The resulting W/O emulsion explosive composition was fed into a packing machine 14 (tube packing machine) by means of a pump 13, and packed into two kinds of W/O emulsion explosive cartridges which had the same diameters as those in Comparative example 1.

The resulting two kinds of W/O emulsion explosive cartridges were subjected to the same tests as described in Comparative example 1. The obtained results are shown in Table 1.

| | Example 1 | | Comparative Example 1 | | Comparative Example 2 | |
|---|---|---|---|---|---|---|
| | Cartridge diameter (mm) | | | | | |
| | 25Ø | 50Ø | 25Ø | 50Ø | 25Ø | 50Ø |
| | Just after the production | | | | | |
| Density | 1.15 | 1.11 | 1.22 | 1.24 | 1.21 | 1.23 |
| Detonation velocity at 20° C. (m/sec) | 5,600 | 5,630 | 4,870 | 5,020 | 5,000 | 5,100 |
| Low temperature detonability | −35 | −35 | −15 | −20 | −20 | −20 |

-continued

| | Example 1 | | Comparative Example 1 | | Comparative Example 2 | |
|---|---|---|---|---|---|---|
| | Cartridge diameter (mm) | | | | | |
| | 25Ø | 50Ø | 25Ø | 50Ø | 25Ø | 50Ø |
| (°C.) | | | | | | |
| Breakage of shirasu hollow microspheres (wt. %) *1 | 4 | | 23 | | 30 | |
| | One year after the production | | | | | |
| Density | 1.17 | 1.19 | 1.24 | 1.25 | 1.23 | 1.24 |
| Detonation velocity at 20°C. (m/sec) | 5,100 | 5,350 | 4,340 | 4,570 | 4,850 | 4,830 |
| Low temperature detonability (° C.) | −30 | −35 | +10 | +10 | −10 | −15 |

Note:
*1Measurement of breakage is carried out on an explosive composition sampled at the outlet of the kneader (Percentage of explosive broken only in the interior of the kneader).

It can be seen from Table 1 that the W/O emulsion explosive (Example 1) produced by the method according to the present invention, wherein novel emulsifying and kneeding steps are carried out, is superior to the W/O emulsion explosive produced by a conventional method in any of performances of explosive itself and further is lower than the conventional emulsion explosive in the breakage of hollow microspheres. Therefore, according to the present invention, the amount of hollow microspheres to be contained in a W/O emulsion explosive as a specific gravity controller for the explosive can be decreased and an explosive having a high performance can be inexpensivey produced.

What is claimed is:

1. A method of producing water-in-oil emulsion explosive, comprising mixing an aqueous solution of inorganic oxidizer with a premixture of oil and emulsifier, emulsifying the mixture into a water-in-oil emulsion through the following emulsifying step (a), and then kneading the resulting water-in-oil emulsion together with hollow microspheres in the following kneading step (b):

(a) said emulsifying step being an emulsifying step, wherein the above described mixture is fed into an emulsifying machine on its disc arranged in the machine and having projections; the mixture is flowed towards the inner wall of the emulsifying machine, while rotating the disc and imposing a shear force to the mixture by the projections arranged on the disc; the emulsified mixture is flowed down from the outer peripheral portion of the disc into a room formed under the disc; the emulsified mixture is further mixed in the room and is extruded therefrom by means of an extruding blade arranged in the room to produce a water-in-oil emulsion; and (b) said kneading step being a kneading step, wherein the above obtained water-in-oil emulsion is kneaded together with hollow microspheres by means of agitating blades which carry out concurrently rotary motion and up and down movements.

* * * * *